US007182616B2

(12) United States Patent
Shuey et al.

(10) Patent No.: US 7,182,616 B2
(45) **Date of Patent: *Feb. 27, 2007**

(54) CONNECTOR RECEPTACLE HAVING A SHORT BEAM AND LONG WIPE DUAL BEAM CONTACT

(75) Inventors: Joseph B. Shuey, Camp Hill, PA (US); Jose L. Ortega, Camp Hill, PA (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/285,409

(22) Filed: Nov. 22, 2005

(65) Prior Publication Data

US 2006/0073724 A1 Apr. 6, 2006

Related U.S. Application Data

(63) Continuation of application No. 10/232,353, filed on Aug. 30, 2002, now Pat. No. 7,008,250.

(51) Int. Cl.
*H01R 13/15* (2006.01)

(52) U.S. Cl. ..... 439/265; 439/268; 439/857

(58) Field of Classification Search ..... 439/265, 439/268, 263, 682, 636, 733.1, 856, 857, 439/743, 746, 751
See application file for complete search history.

(56) References Cited

U.S. PATENT DOCUMENTS

| | | | | |
|---|---|---|---|---|
| 3,115,379 | A | 12/1963 | McKee | 339/47 |
| 3,286,220 | A | 11/1966 | Marley et al. | 439/680 |
| 3,538,486 | A | 11/1970 | Shlesinger, Jr. | 339/74 |
| 3,669,054 | A | 6/1972 | Desso et al. | 113/119 |
| 3,704,441 | A | 11/1972 | Douglass | 339/220 |
| 3,725,853 | A * | 4/1973 | McKeown et al. | 439/836 |
| 3,731,252 | A * | 5/1973 | McKeown et al. | 439/59 |
| 3,748,633 | A | 7/1973 | Lundergan | 339/217 S |
| 4,076,362 | A | 2/1978 | Ichimura | 339/75 |
| 4,140,361 | A | 2/1979 | Sochor | 339/258 |
| 4,159,861 | A | 7/1979 | Anhalt | 339/75 |
| 4,260,212 | A | 4/1981 | Ritchie et al. | 339/97 R |
| 4,288,139 | A | 9/1981 | Cobaugh et al. | 339/74 R |
| 4,383,724 | A | 5/1983 | Verhoeven | 339/19 |
| 4,402,563 | A | 9/1983 | Sinclair | 339/75 M |
| 4,480,888 | A * | 11/1984 | Hopkins et al. | 439/267 |
| 4,560,222 | A | 12/1985 | Dambach | 339/75 |
| 4,607,907 | A | 8/1986 | Bogursky | 339/258 |
| 4,684,193 | A * | 8/1987 | Havel | 439/259 |
| 4,717,360 | A | 1/1988 | Czaja | 439/710 |

(Continued)

FOREIGN PATENT DOCUMENTS

| | | |
|---|---|---|
| EP | 0 273 683 A2 | 7/1988 |

(Continued)

*Primary Examiner*—Tho D. Ta
(74) *Attorney, Agent, or Firm*—Woodcock Washburn LLP

(57) ABSTRACT

A contact assembly for use in an electrical connector. The contact assembly includes an insulative contact block defining a plurality of apertures therethrough. The contacts assembly also includes a plurality of dual beam contact terminals. Each plurality of dual beam contact terminals extends through an aperture in the contact block wherein the dual beam contact terminals are seated within the aperture of the contact block at an inwardly directed tension that maintains a desired spring rate on the contacts.

22 Claims, 11 Drawing Sheets

U.S. PATENT DOCUMENTS

| | | | | |
|---|---|---|---|---|
| 4,728,164 | A | 3/1988 | Lemmens et al. | 439/870 |
| 4,776,803 | A | 10/1988 | Pretchel et al. | 439/59 |
| 4,815,987 | A | 3/1989 | Kawano et al. | 439/263 |
| 4,867,713 | A | 9/1989 | Ozu et al. | 439/833 |
| 4,878,861 | A | 11/1989 | Kendall et al. | 439/751 |
| 4,907,990 | A | 3/1990 | Bertho et al. | 439/851 |
| 4,936,797 | A | 6/1990 | Wehrle et al. | 439/751 |
| 4,964,814 | A | 10/1990 | Tengler et al. | 439/607 |
| 4,973,271 | A | 11/1990 | Ishizuka et al. | 439/839 |
| 5,066,236 | A | 11/1991 | Broeksteeg | 439/79 |
| 5,077,893 | A | 1/1992 | Mosquera et al. | 29/882 |
| 5,174,770 | A | 12/1992 | Sasaki et al. | 439/108 |
| 5,238,414 | A | 8/1993 | Yaegashi et al. | 439/108 |
| 5,254,012 | A | 10/1993 | Wang | 439/263 |
| 5,274,918 | A | 1/1994 | Reed | 29/882 |
| 5,302,135 | A | 4/1994 | Lee | 439/263 |
| 5,403,215 | A | 4/1995 | Buchter et al. | 439/869 |
| 5,431,578 | A | 7/1995 | Wayne | 439/259 |
| 5,475,922 | A | 12/1995 | Tamura et al. | 29/881 |
| 5,487,684 | A | 1/1996 | Schalk et al. | 439/715 |
| 5,558,542 | A | 9/1996 | O'Sullivan et al. | 439/682 |
| 5,564,954 | A | 10/1996 | Wurster | 439/751 |
| 5,573,431 | A | 11/1996 | Wurster | 439/751 |
| 5,588,859 | A | 12/1996 | Maurice | 439/290 |
| 5,590,463 | A | 1/1997 | Feldman et al. | 29/844 |
| 5,609,502 | A | 3/1997 | Thumma | 439/47 |
| 5,645,436 | A | 7/1997 | Shimizu et al. | 439/108 |
| 5,676,570 | A | 10/1997 | Scherer | 439/787 |
| 5,697,818 | A | 12/1997 | Fukuda | 439/751 |
| 5,730,609 | A | 3/1998 | Harwath | 439/108 |
| 5,741,144 | A | 4/1998 | Elco et al. | 439/101 |
| 5,741,161 | A | 4/1998 | Cahaly et al. | 439/709 |
| 5,761,050 | A | 6/1998 | Archer | 361/791 |
| 5,795,191 | A | 8/1998 | Preputnick et al. | 439/608 |
| 5,817,973 | A | 10/1998 | Elco et al. | 174/32 |
| 5,908,333 | A | 6/1999 | Perino et al. | 439/631 |
| 5,961,355 | A | 10/1999 | Morlion et al. | 439/686 |
| 5,971,817 | A | 10/1999 | Longueville | 439/857 |
| 5,980,271 | A | 11/1999 | MacDougall et al. | 439/78 |
| 5,980,321 | A | 11/1999 | Cohen et al. | 439/608 |
| 5,993,259 | A | 11/1999 | Stokoe et al. | 439/608 |
| 6,050,862 | A | 4/2000 | Ishii | 439/843 |
| 6,068,520 | A | 5/2000 | Winings et al. | 439/676 |
| 6,123,554 | A | 9/2000 | Ortega et al. | 439/79 |
| 6,125,535 | A | 10/2000 | Chiou et al. | 29/883 |
| 6,139,336 | A | 10/2000 | Olson | 439/83 |
| 6,146,157 | A | 11/2000 | Lenoir et al. | 439/101 |
| 6,146,203 | A | 11/2000 | Elco et al. | 439/609 |
| 6,190,213 | B1 | 2/2001 | Reichart et al. | 439/736 |
| 6,212,755 | B1 | 4/2001 | Shimada et al. | 29/527.1 |
| 6,219,913 | B1 | 4/2001 | Uchiyama | 29/883 |
| 6,220,896 | B1 | 4/2001 | Bertoncici et al. | 439/608 |
| 6,269,539 | B1 | 8/2001 | Takahashi et al. | 29/883 |
| 6,293,827 | B1 | 9/2001 | Stokoe et al. | 439/608 |
| 6,319,075 | B1 | 11/2001 | Clark et al. | 439/825 |
| 6,325,643 | B1 | 12/2001 | Ohtsuki et al. | 439/82 |
| 6,328,602 | B1 | 12/2001 | Yamasaki et al. | 439/608 |
| 6,347,952 | B1 | 2/2002 | Hasegawa et al. | 439/608 |
| 6,350,134 | B1 | 2/2002 | Fogg et al. | 439/79 |
| 6,363,607 | B1 | 4/2002 | Chen et al. | 29/883 |
| 6,371,773 | B1 | 4/2002 | Crofoot et al. | 439/79 |
| 6,379,188 | B1 | 4/2002 | Cohen et al. | 439/608 |
| 6,386,914 | B1 | 5/2002 | Collins et al. | 439/579 |
| 6,409,543 | B1 | 6/2002 | Astbury, Jr. et al. | 439/608 |
| 6,431,914 | B1 | 8/2002 | Billman | 439/608 |
| 6,435,914 | B1 | 8/2002 | Billman | 439/608 |
| 6,454,575 | B1 | 9/2002 | Jones et al. | 439/79 |
| 6,454,615 | B1 | 9/2002 | Yu | 439/752.5 |
| 6,461,202 | B2 | 10/2002 | Kline | 439/701 |
| 6,471,548 | B2 | 10/2002 | Bertoncini et al. | 439/608 |
| 6,506,081 | B2 | 1/2003 | Blanchfield et al. | 439/682 |
| 6,537,111 | B2 | 3/2003 | Brammer et al. | 439/857 |
| 6,554,647 | B1 | 4/2003 | Cohen et al. | 439/607 |
| 6,572,410 | B1 | 6/2003 | Volstorf et al. | 439/608 |
| 6,652,318 | B1 | 11/2003 | Winnings et al. | 439/608 |
| 6,692,272 | B2 | 2/2004 | Lemke et al. | 439/108 |
| 2001/0010979 | A1 | 8/2001 | Ortega et al. | 439/79 |
| 2003/0143894 | A1 | 7/2003 | Kline | 439/608 |
| 2003/0220021 | A1 | 11/2003 | Whiteman, Jr. et al. | 439/608 |

FOREIGN PATENT DOCUMENTS

| | | |
|---|---|---|
| JP | 06-236788 | 8/1994 |
| JP | 07-114958 | 5/1995 |
| JP | 2000/003743 | 1/2000 |
| JP | 2000/003744 | 1/2000 |
| JP | 2000-003745 | 1/2000 |
| JP | 2000-003746 | 1/2000 |
| WO | WO 01/29931 A1 | 4/2001 |
| WO | WO 01/39332 A1 | 5/2001 |

* cited by examiner

CONNECTOR RECEPTACLE HAVING A SHORT BEAM AND LONG WIPE DUAL BEAM CONTACT

CROSS-REFERENCE TO RELATED APPLICATIONS

This application is a continuation of U.S. patent application Ser. No. 10/232,353, filed Aug. 30, 2002 now U.S. Pat. No. 7,008,250. The subject matter disclosed in this patent application is related to the subject matter disclosed and claimed in U.S. patent application Ser. No. 11/087,047, filed Mar. 22, 2005 now U.S. Pat. No. 6,988,902, which is a continuation of U.S. patent application Ser. No. 10/294,966, filed on Nov. 14, 2002 now U.S. Pat. No. 6,976,886, which is a continuation-in-part of U.S. Pat. Nos. 6,652,318 and 6,692,272. The contents of each of the above-referenced U.S. patents and patent applications are herein incorporated by reference in their entireties.

FIELD OF THE INVENTION

This invention relates in general to electrical connectors. Specifically, this invention relates to an electrical connector having an improved contact assembly.

BACKGROUND OF THE INVENTION

Electrical connectors are typically used to connect multiple electrical devices such that the electrical devices may electrically communicate. To facilitate communication, electrical connectors include electrically conductive contacts or terminals to pass electrical signals from device to device. Electrical contacts are typically manufactured using a stamping process. Stamping is a manufacturing technique that transforms a relatively thin sheet of metal into a predetermined design by pressing the sheet of metal between machinery at tremendous forces.

To meet the ever-increasing demand for the miniaturization of electrical connectors, the electrical contacts therein must also be very small. As a result, the manufacturing tolerances used in the stamping process must be restrictive in order to manufacture a relatively small contact to a predetermined design suitable for fit into an electrical connector One example of a stamped terminal design is a terminal having a dual beam configuration. When a dual beam contact is stamped, the resulting terminal must meet certain predetermined design criteria for use in an electrical connector. One such predetermined design criteria is spring rate. The spring rate of a contact terminal is defined as how much force is required to deflect the contact a distance; spring rate is measured in force per unit distance. Consequently, the stamping process must be tailored with restrictive tolerances such that the resulting stamped terminals have the proper spring rate for use in an electrical connector. However, achieving the restrictive tolerances required to stamp contacts with a determined spring rate can be expensive and time-consuming.

Consequently, there is a need for an electrical connector that can use contacts manufactured without such restrictive tolerances.

BRIEF SUMMARY OF THE INVENTION

The invention provides a contact assembly for use in an electrical connector that can use contact terminals stamped without such restrictive tolerances. As such, the invention, among other things, reduces the overall costs associated with the manufacture of the electrical connector while still providing an electrical connector that meets the specification of a connector made with contact terminals stamped using restrictive tolerances.

In accordance with one embodiment of the invention, a contact assembly for use in an electrical connector is provided. Specifically, the contact assembly includes an insulative contact block defining a plurality of apertures therethrough and a plurality of dual beam contact terminals. Each plurality of dual beam contact terminals extends through an aperture in the contact block wherein the dual beam contact terminals are seated within the aperture of the contact block at an inwardly directed tension that maintains a desired spring rate on the contacts.

BRIEF DESCRIPTION OF THE DRAWINGS

The invention is further described in the detailed description that follows, by reference to the noted drawings by way of non-limiting illustrative embodiments of the invention, in which like reference numerals represent similar parts throughout the drawings, and wherein.

DETAILED DESCRIPTION OF THE INVENTION

Figure 1:
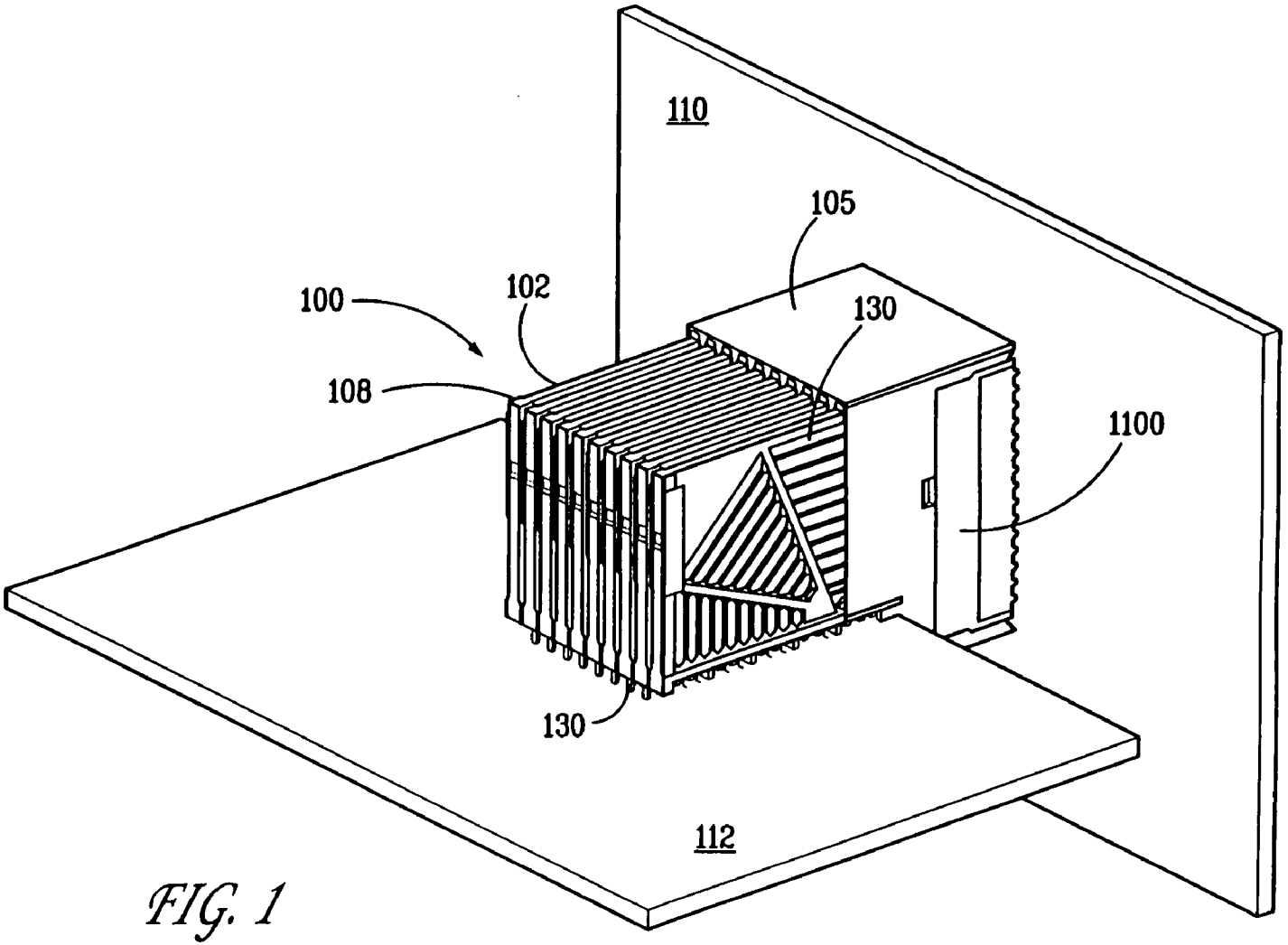
FIG. 1 is a perspective view of a backplane system having an exemplary right angle electrical connector in accordance with the invention.

FIG. 1 is a perspective view of a backplane system having an exemplary right angle electrical connector in accordance with an embodiment of the invention. However, the invention may take other forms such as a vertical or horizontal electrical connector. As shown in FIG. 1, connector 100 comprises a plug 102 and receptacle 1100.

Plug 102 comprises a housing 105 and a plurality of lead assemblies 108. The housing 105 is configured to contain and align the plurality of lead assemblies 108 such that an electrical connection suitable for signal communication is made between a first electrical device 112 and a second electrical device 110 via receptacle 1100. In one embodiment of the invention, electrical device 110 is a backplane and electrical device 112 is a daughtercard. Electrical devices 110 and 112 may, however, be any electrical device without departing from the scope of the invention.

As shown, the connector plug 102 comprises a plurality of lead assemblies 108. Each lead assembly 108 comprises a column of terminals or conductors 130 therein as will be described below. Each lead assembly 108 comprises any number of terminals 130.

Figure 1A:
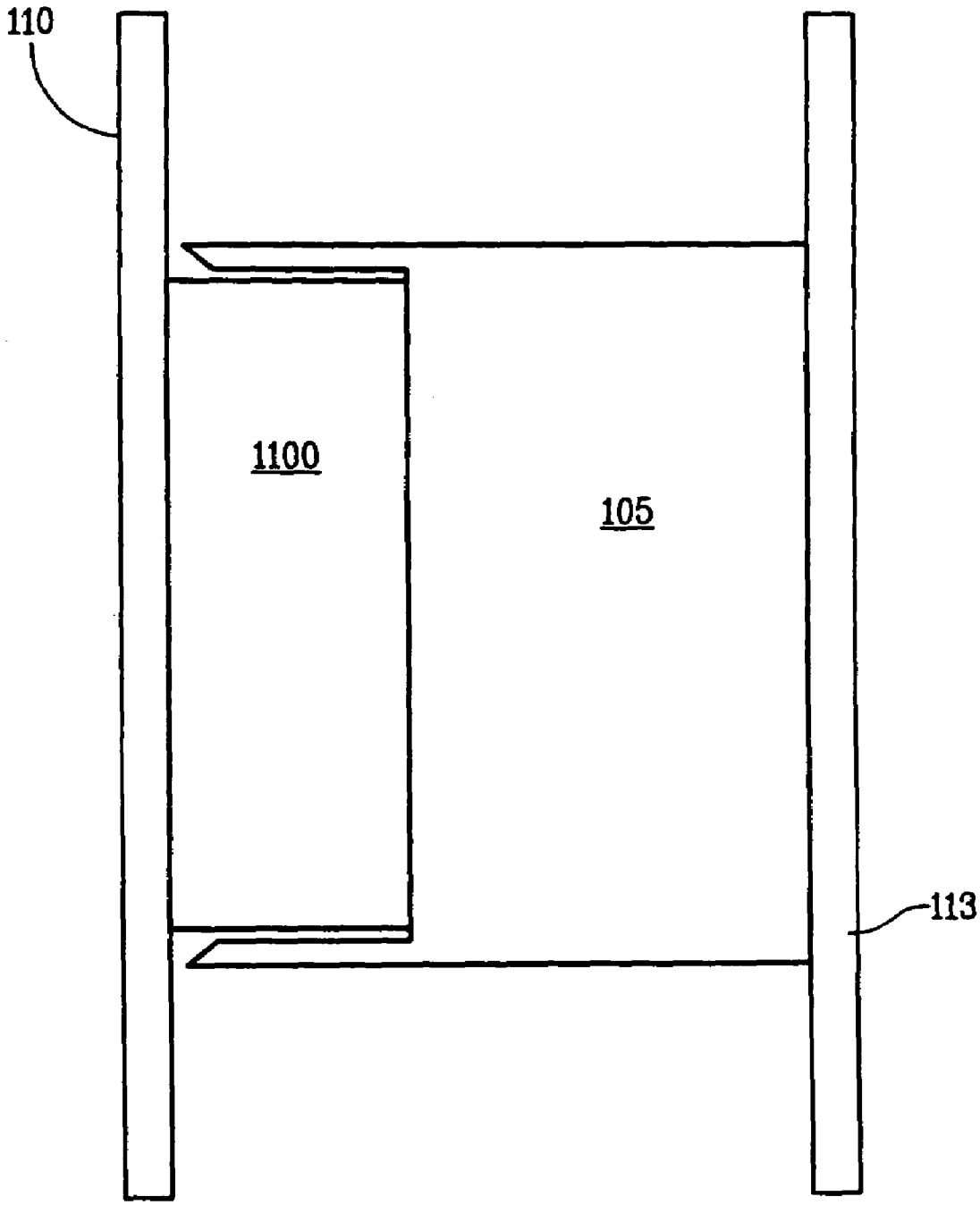
FIG. 1*a* is a simplified view of a board-to-board system having a vertical connector in accordance with the invention.

FIG. 1*a* is a board-to-board system similar to FIG. 1 except plug connector 106 is a vertical plug connector rather than a right angle plug connector as shown in FIG. 1. This embodiment makes electrical connection between two parallel electrical devices 110 and 113.

Figure 2:
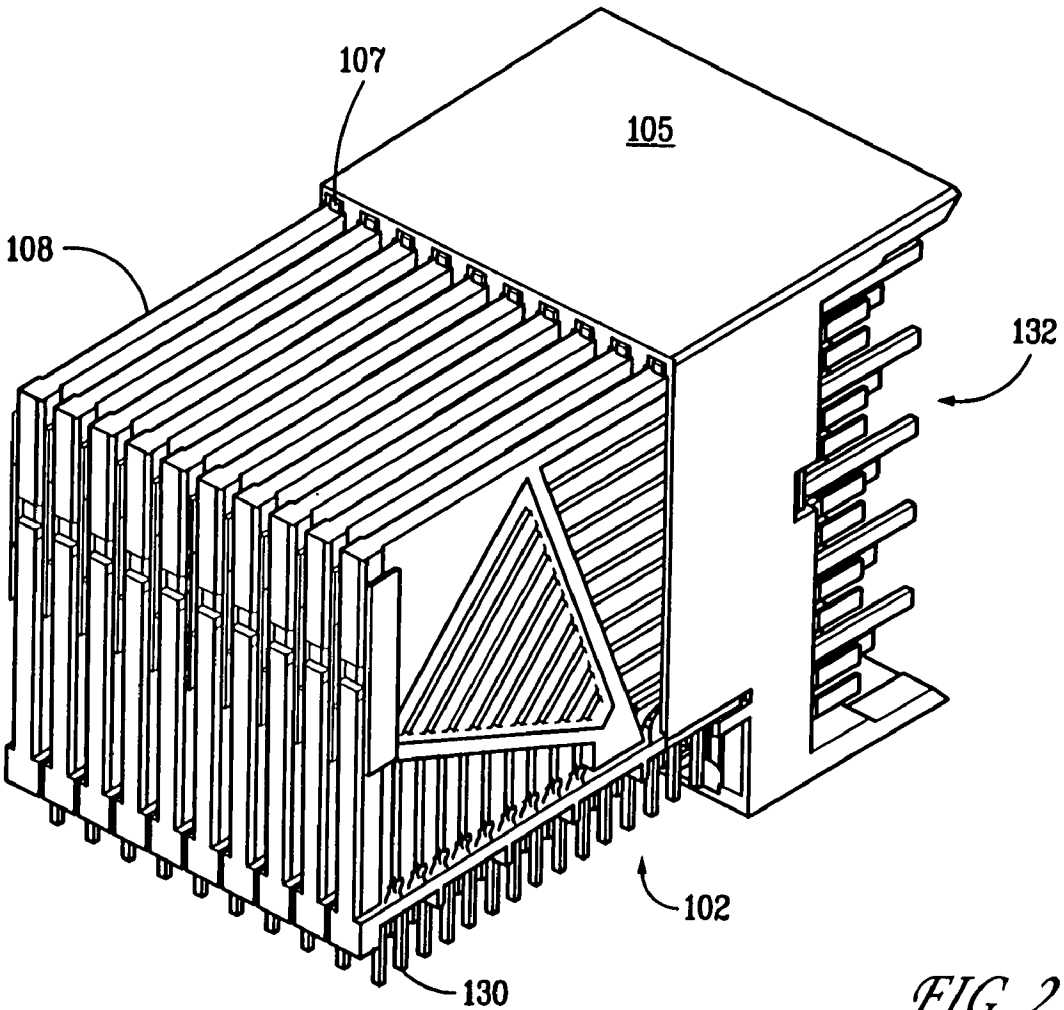
FIG. 2 is a perspective view of the connector plug portion of the connector shown in FIG. 1.

FIG. 2 is a perspective view of the plug connector 102 of FIG. 1 shown without electrical devices 110 and 112 and receptacle connector 1100. As shown, slots 107 are formed in the housing 105 that contain and align the lead assemblies 108 therein. In one embodiment, the housing 105 is made of plastic, however, any suitable material may be used without departing from the scope of the invention. FIG. 2 also shows connection pins 130, 132. Connection pins 130 connect connector 102 to electrical device 112. Connection pins 132 electrically connect connector 102 to electrical device 110 via receptacle 1100. Connection pins 130 may be adapted to provide through-mount or surface-mount connections to an electrical device (not shown).

Figure 3:
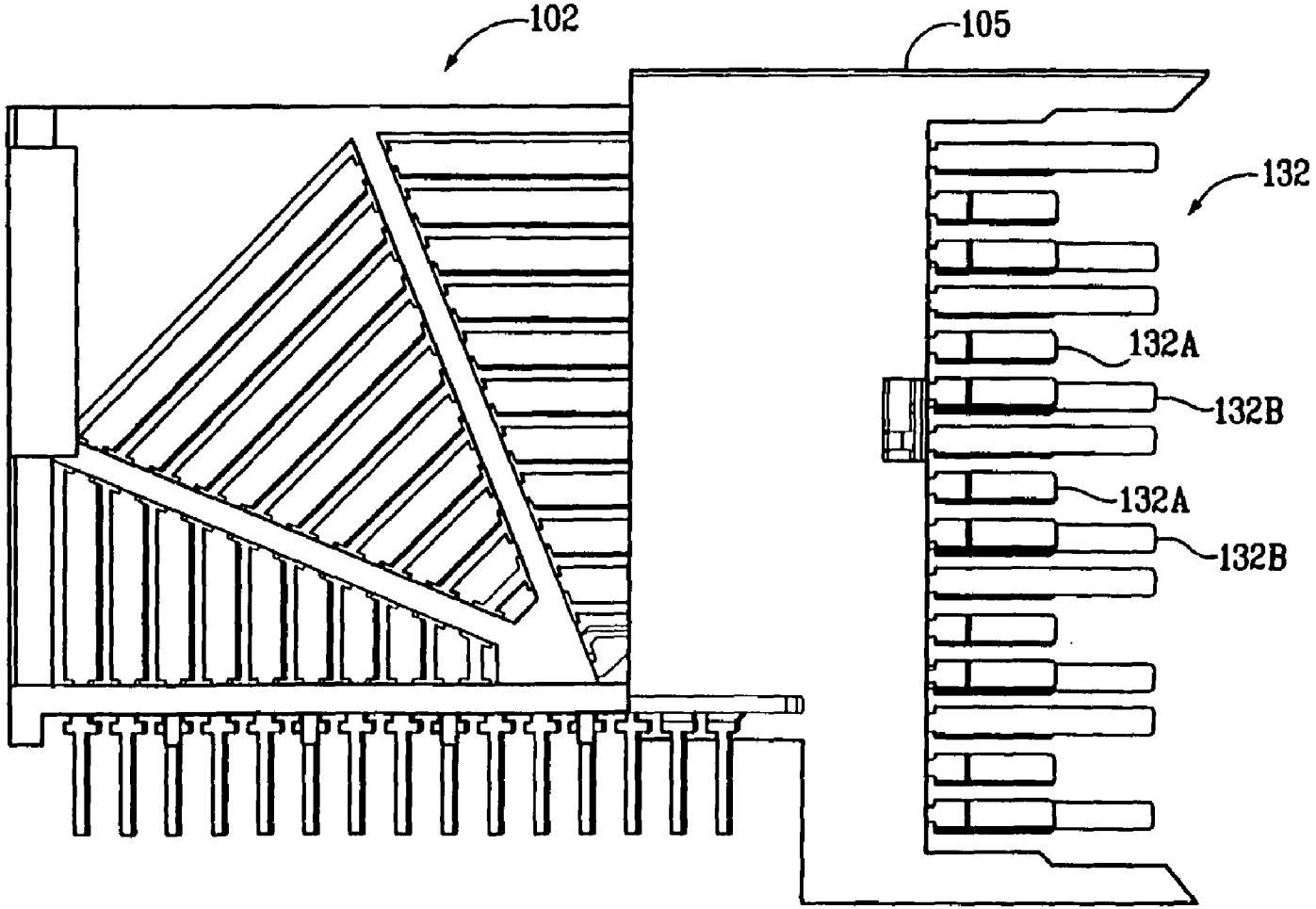
FIG. 3 is a side view of the connector plug portion of the connector shown in FIG. 1.

FIG. 3 is a side view of plug connector 102 as shown in FIG. 2. As shown, in this configuration, the terminals 132 used to connect to receptacle 1100 vary in length, i.e. the terminals extend in varied lengths from the end of the housing 105 from which the terminals 132 extend. For example, as shown, terminals 132B are ground terminals and extend a greater distance from housing 105 than terminals 132A, which are signal terminals. During mating of the connector plug 102 to receptacle 1100, such configuration provides that the longer ground terminals 132B on plug 102 will mate with the corresponding ground terminals on the receptacle 1100 before the shorter signal terminals 132A mate with the corresponding signal terminals 1175A on the receptacle 1100. Such a configuration can be used to ensure that signal integrity is maintained when plug 102 is mated with receptacle 1100.

Figure 4:
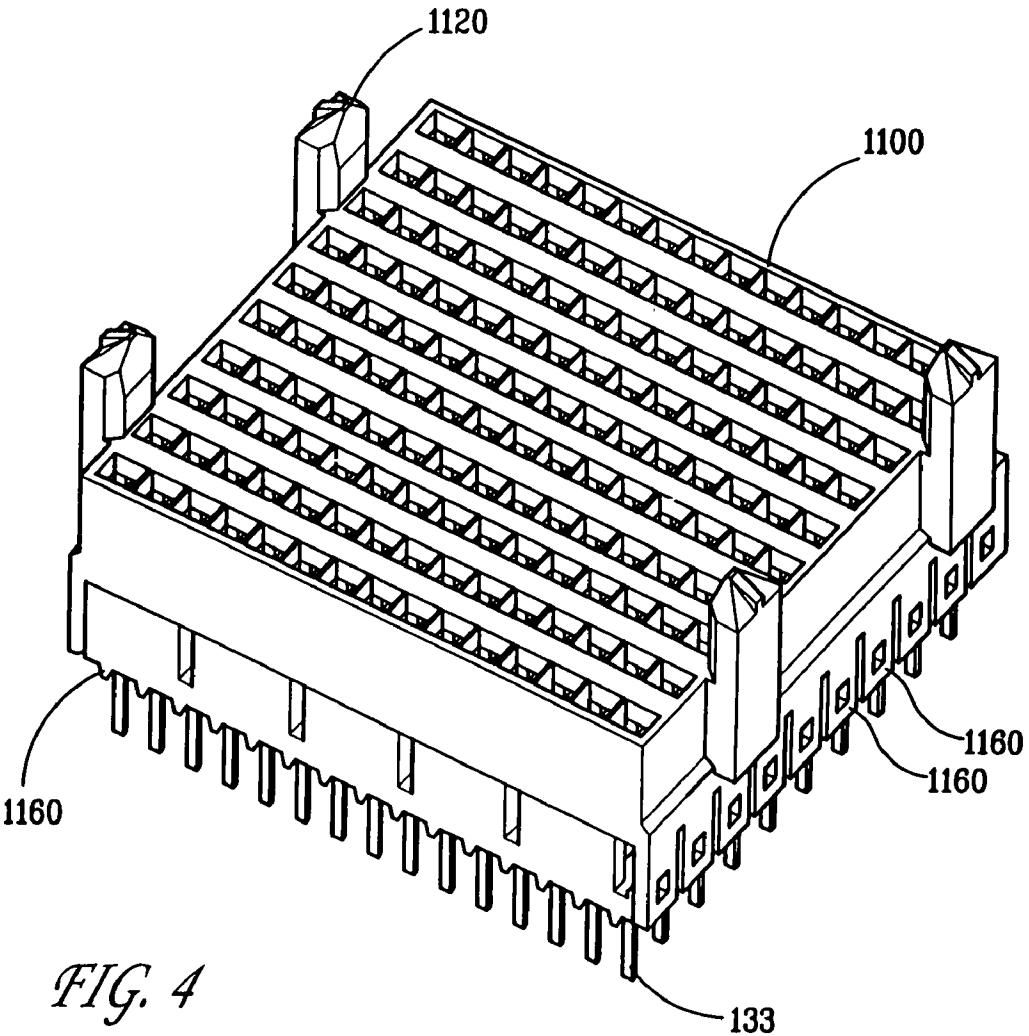
FIG. 4 is a perspective view of the receptacle portion of the connector shown in FIG. 1.
Figure 5:
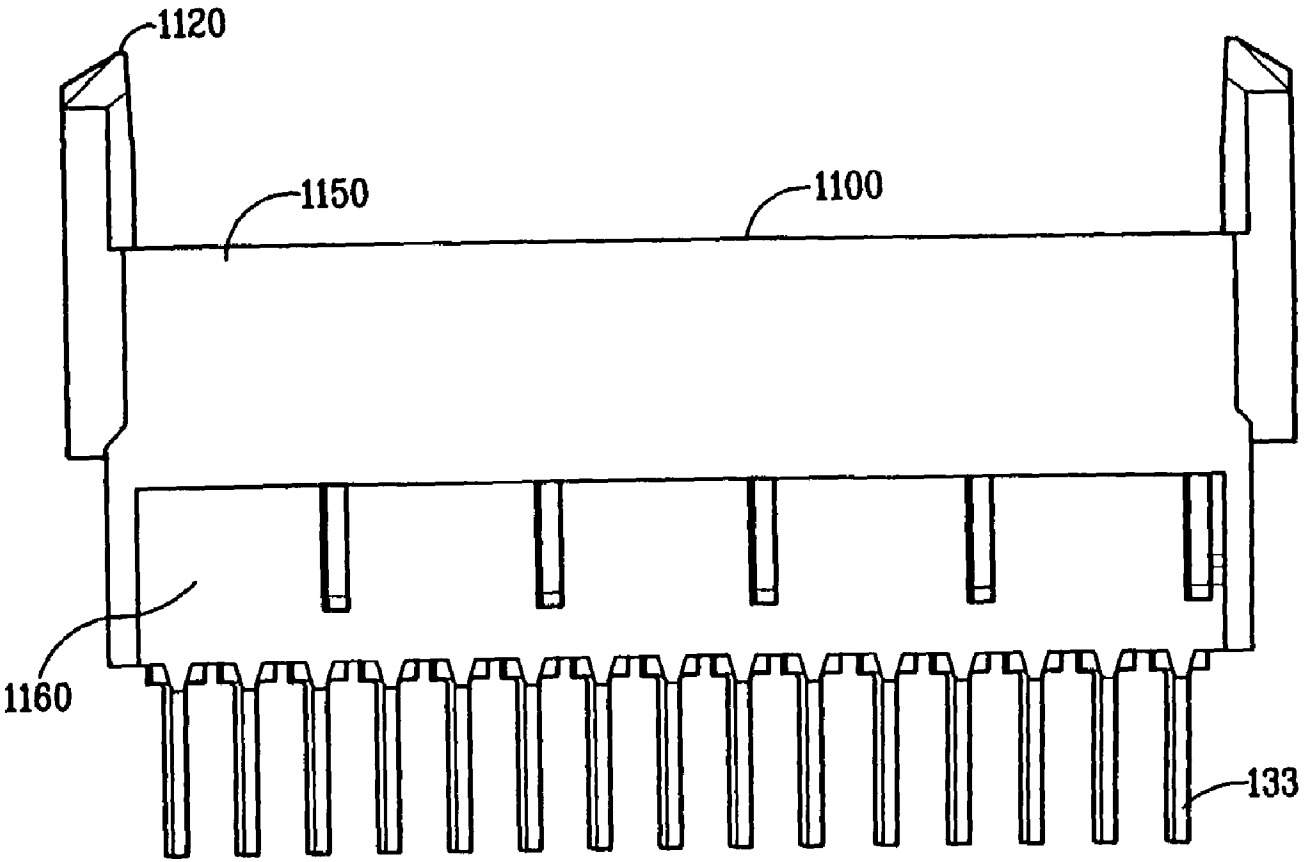
FIG. 5 is a side view of the receptacle portion of the connector shown in FIG. 4.

FIGS. 4 and 5 are a perspective view and side view, respectively, of the receptacle 1100 portion of the connector shown in FIG. 1. In this manner, receptacle 1100 may be mated with connector plug 102 (as shown in FIG. 1) and used to connect two electrical devices (as shown in FIG. 1). Specifically, connection pins or contact terminals 133 may be inserted into, for example, vias (not shown) on device 110 to electrically connect connector plug 102 to device 110. In another embodiment of the invention, the connection pins 133 may be eye-of-the-needle pins for use in press-fit applications.

Receptacle 1100 also includes alignment structures 1120 to aid in the alignment and insertion of connector plug 102 into receptacle 1100. Once inserted, structures 1120 also serve to secure the connector plug in receptacle 1100. Such structures 1120 thereby resist any movement that may occur between the connector and receptacle that could result in mechanical breakage therebetween.

Figure 6:
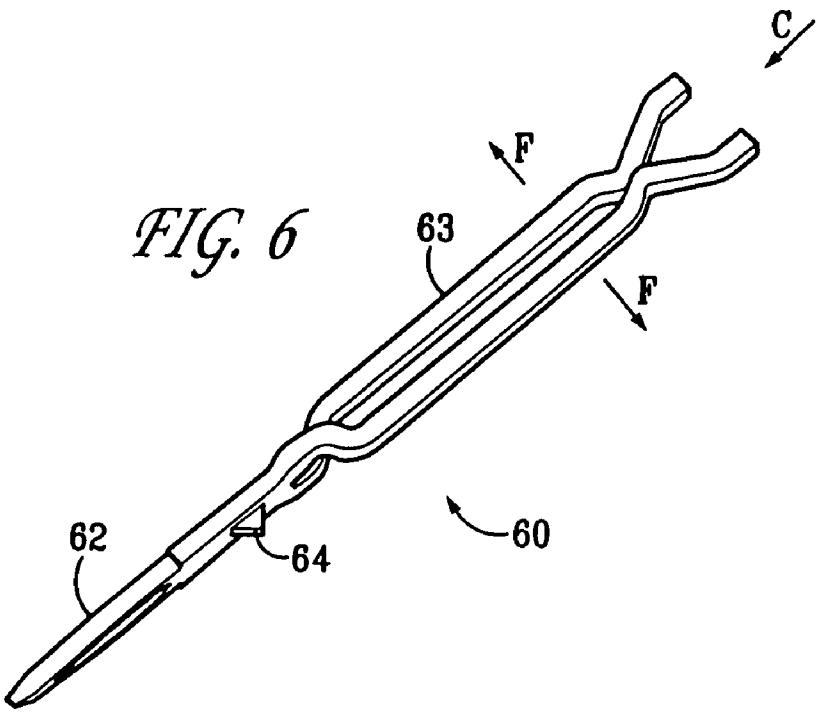
FIG. 6 is a perspective view of a stamped terminal.

FIG. 6 is a perspective view of a stamped contact terminal 60 manufactured using a process wherein tolerances are designed into the contact to provide a contact having a determined spring rate and gap. As shown, terminal 60 includes a dual beam contact 63 on one end of the terminal 60 and an eye of the needle configuration 62 on the other end of the terminal 60. In another embodiment of the invention, the eye of the needle configuration can be replaced with a straight pin configuration without departing from the scope of the invention. Terminal 60 also includes a projection 64 for securing the terminal 60 in a contact block (not shown).

Dual beam contact terminals 63 have a spring rate associated therewith. The spring rate of a dual beam contact 63 is defined as how much force is required to deflect the beams of the contact a distance, is measured in force per unit distance, and is inversely proportional to the free length of the beam (While other factors effect spring rate, they are not relevant to this invention). For example, when a contact having a blade-like configuration (not-shown), is inserted into terminal 60 in a direction as indicated by arrow C, the beams of terminal 60 are deflected in a direction indicated by arrows F. Consequently, depending on the spring rate of terminal 60, the force required to insert the blade-like contact (not shown) into terminal 60 may vary. Generally, terminals in a connector must have a target normal force for proper mating with a complementary connector.

Dual beam contact terminals 63 have a gap associated therewith. This gap is sized for the proper fitting of the terminal of the mating connector. The creation of this gap and its associated tolerances via stamping is a complex mechanical process.

The present invention can utilize dual beam contact terminals which are stamped with less restrictive tolerances and the resulting economy. In accordance with the present invention, the spring rate and the resultant normal force, is determined by the way the dual beam contact is inserted in the contact block (after the stamping operation). As mentioned above, the spring rate of a stamped beam is inversely proportional to the free length of the beam. Accordingly, once the stamped terminals are inserted into the contact block, as will be described in detail below, the spring rate can be adjusted by varying the free length of the beam protruding from the contact block, for example, by controlling the size and depth of the bore in the contact block.

Figure 7:
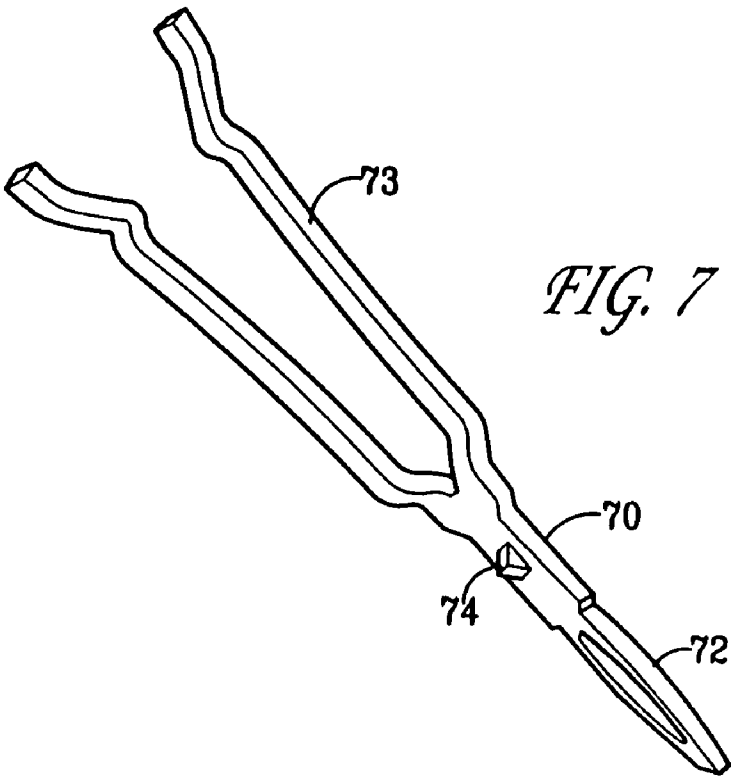
FIG. 7 is a perspective view of another stamped terminal.

In accordance with the invention, a contact assembly for use in an electrical connector is provided that uses stamped terminals made without the stamping tolerances needed to produce a contact having a predetermined spring rate. In this manner, a contact assembly is provided that adjusts the contact's spring rate when inserting the contact into the contact block. FIG. 7 is a perspective view of a terminal stamped using a process without the tolerances as described above with respect to the prior art that still result in a stamped terminal having a pre-determined spring rate when inserted into the easily manufactured contact block. As shown, the dual beams 73 are relatively long and consequently would render a relatively high spring rate. Furthermore, because the contact block will be used to maintain the beam gap, the gap does not have to be held with tight tolerances in the terminal itself and therefore terminal 70 is less difficult and faster to manufacture. As a result, the terminal is less expensive to manufacture since the restrictive tolerances used to create the desired spring force and gap have been removed.

Figure 8:
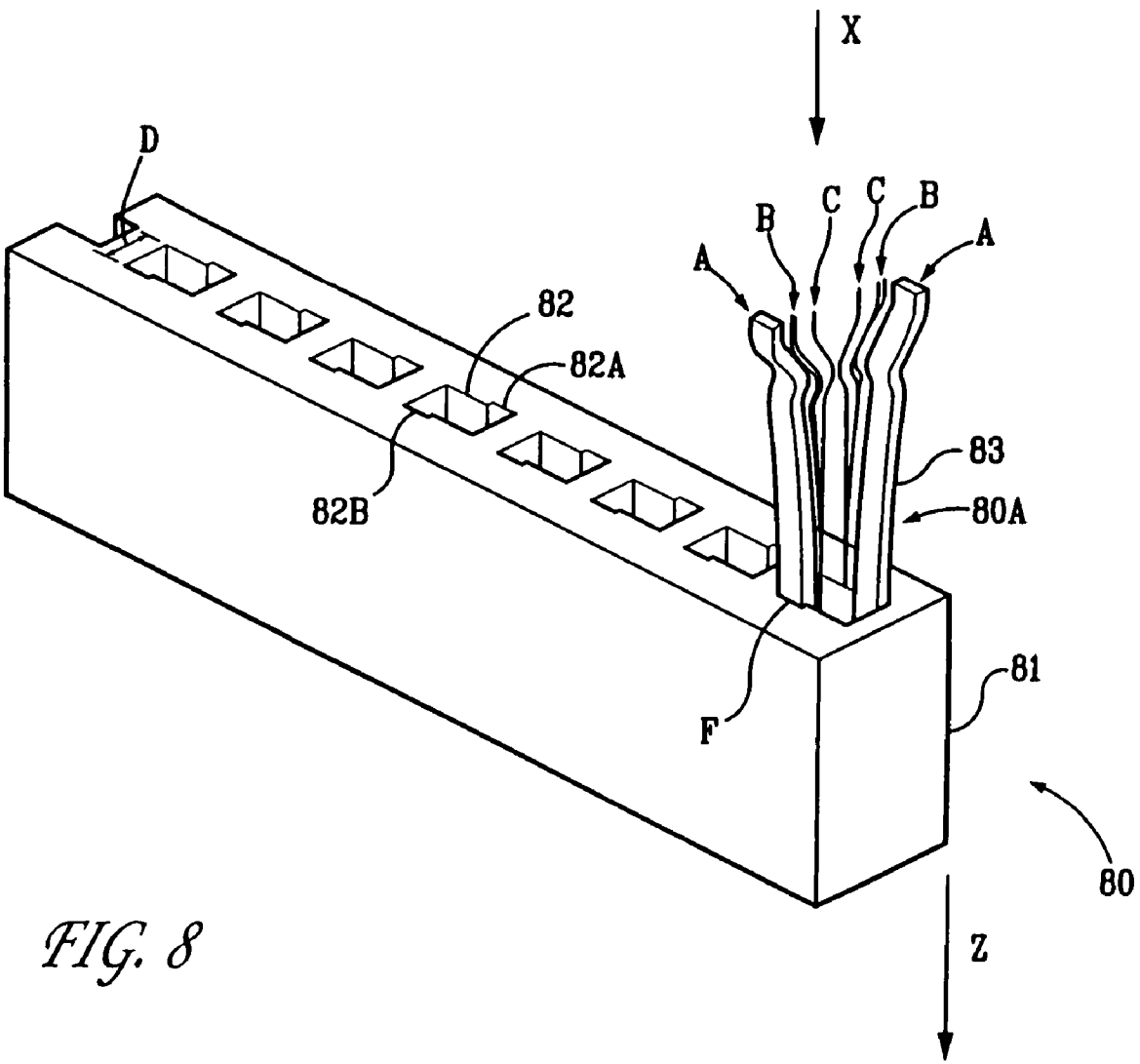
FIG. 8 is a perspective view of a single contact assembly made in accordance with the invention.
Figure 9:
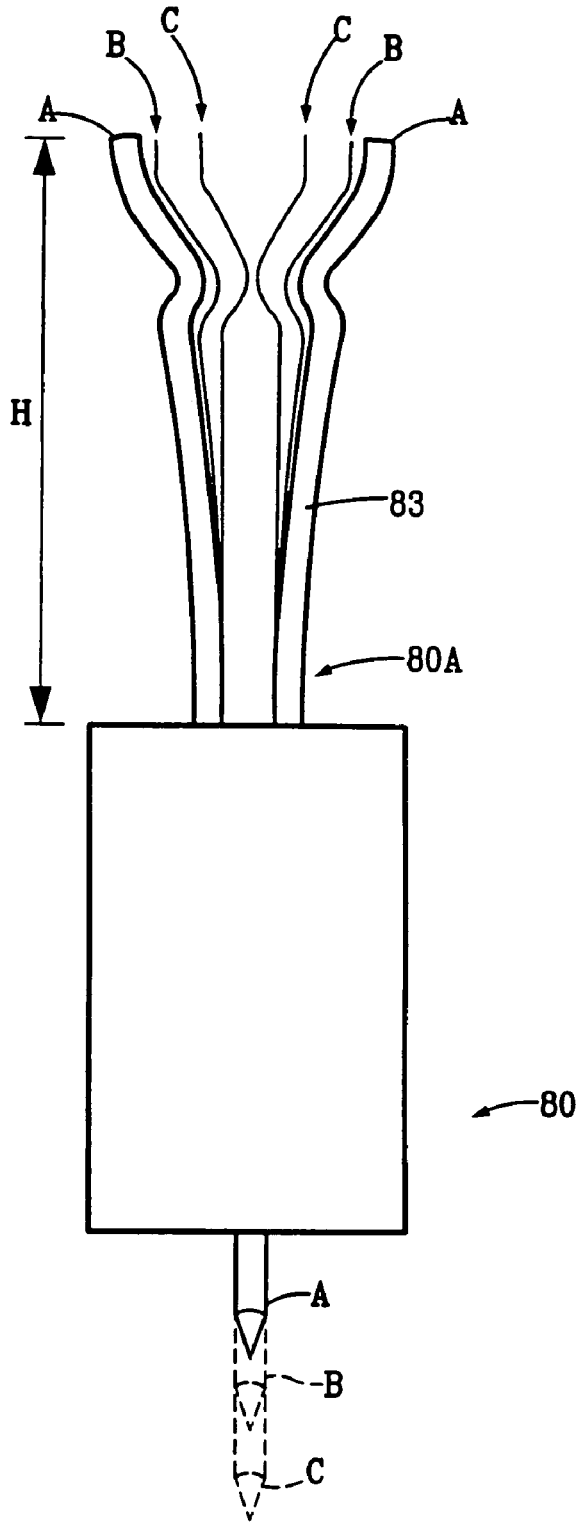
FIG. 9 is a side view of the contact assembly of FIG. 8.

FIGS. 8 and 9 are a perspective and side view, respectively, of a contact assembly 80 in accordance with one aspect of the invention. In particular, FIGS. 8 and 9 are used to illustrate how the contact block 81 is used to adjust the spring rate of a non-tensioned stamped terminal in accordance with the invention.

Generally, it is desirable to maintain a contact force normal to the mating blade or dual beams 83. For example, a minimum threshold contact force may be needed to make reliable contact (which may vary depending on the materials and shape). Also, a maximum threshold force may be needed to minimize the insertion force of multiple contact array connectors)(not shown). The desired contact force can be accomplished by using a beam 83 having a high spring rate and a short deflection or a beam with a low spring rate and a large deflection. A low spring rate is usually desirable as variation with tolerance is decreased. However, if the spring rate is too low, other mechanical constraints may prevent a very large deflection, rendering the contact unusable.

In accordance with the present invention, the spring rate is varied according to the length of the beams protruding above the contact block 81. As shown, contact assembly 80 includes contact block 81 with a single terminal 80A partially inserted within one of the apertures 82. Position A shows the beam before its length is dictated by its insertion in the contact block. As shown, partially inserted terminal 80A has dual beams 83 at position A and dual beams have a spring rate A'. A given spring rate is created in this case, by varying the free length of the beams. For purposes of the disclosure, Applicants refer to this the force the contact block 81 places on the beams as an inwardly directed tension. The tension can also be referred to as an outwardly directed tension without departing from the scope of the invention.

As the terminal 80A is inserted further into contact block 81 at direction indicated by arrow Z, the free-length of the beam 83 decreases and the dual beams 83 move closer together due to the size of the bore in the contact block 81. At position B, the beams 83 have a spring rate B' associated thereat. Spring rate B' is typically greater than spring rate A' since, at position B, the dual beams have a smaller free length and therefore a greater inwardly directed tension created by contact block 81. Position B is created if the beam is tensioned by the contact block 81 to reduce the forces of mating while maintaining a satisfactory normal force. Therefore, when a mating contact (not shown) is inserted into dual beam contact 80A at a direction X, the dual beams 80A are deflected less of a distance due to the greater inwardly directed tension.

As terminal 80A is inserted into contact block 81 along a direction as indicated by arrow Z, dual beams 83 decrease even more in free length until they are seated at position C. Position C shows the beam in a position as defined by the aperture of the contact block 81. Consequently, dual beams have a spring rate C' associated with position C within contact block 81. Typically, spring rate C' is greater than spring rate B' since, at position C, the dual beams 83 have a greater inwardly directed tension created by contact block 81. Therefore, when a contact (not shown) is inserted into dual beam contact 80A at a direction X, the dual beams 80A are deflected less of distance due to the greater inwardly directed tension. In one embodiment, spring rate C' is defined by a customer specification. Therefore, the spring rate of dual beam contact terminals 83 may be adjusted by inserting the contact 83 varying distances into the contact block 81 to control their amount of free length.

Figure 11:
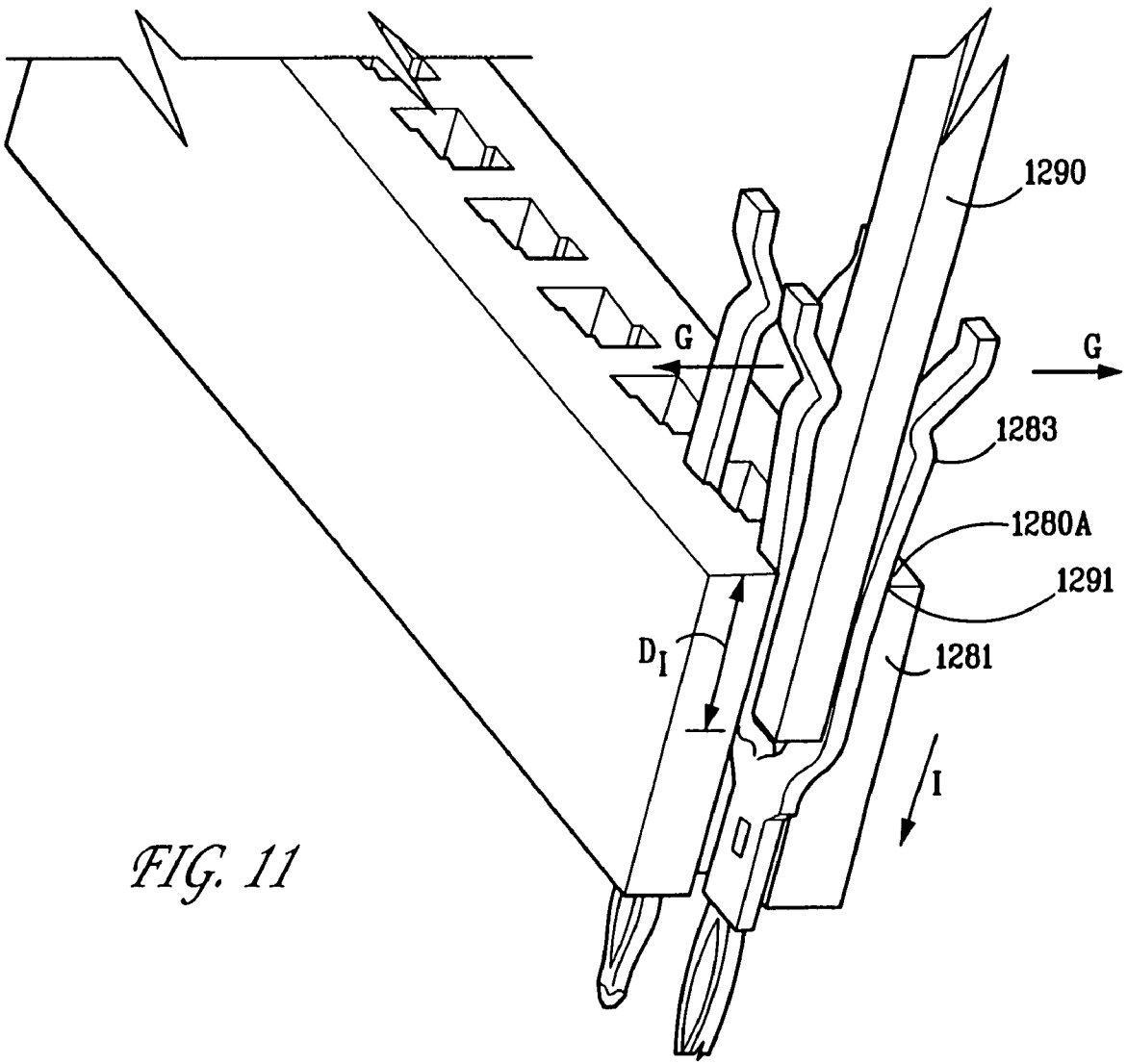
FIG. 11 is a perspective view of a contact assembly in accordance with the invention mated with a pin.

Also, the terminals 80A can be inserted into the contact block 81 such that the dual beams 83 have a desired beam gap once seated in contact block 81. The beam gap is the distance between the dual beam contact terminals at a common point. For example, as shown in FIG. 11, the beam gap is the distance between the dual beam contact terminals at the point furthest from the contact block 1081. In this manner, the beam gap between the dual beams can be adjusted by adjusting the diameter D of the aperture 82 in the contact block. The beam gap may vary, for example, depending on the size of a complementary contact used in mating.

Furthermore, in accordance with another aspect of the invention, the beam height or length of the terminal can be adjusted. The beam height or length (another name for free length) is a value that reflects how far the beam extends from the contact block 81. As shown in FIG. 9, the beam height H is the distance between the distal end of the beam and the contact block. The beam height H, therefore, can be adjusted by inserting the terminal 80A into contact block at varying distances. The beam height can be adjusted to meet engineering or customer specifications or the like without departing from the scope of the invention.

As stated above, by adjusting the beam height, the spring rate of the dual beam contact may also be adjusted. As such, the terminals can be inserted into the contact block 81 such that the dual beams have a desired spring rate. The desired spring rate may be any spring rate. In a preferred embodiment, the spring rate is any rate that is suitable such that the dual beams may properly mate with a complementary connector.

The spring rate of terminal 80A is related to the beam height, which, for example can be measured from the fulcrum point F. In the embodiment shown in FIG. 8, the fulcrum point F is the uppermost point of contact block 81 where the terminal 80A contacts the contact block 1168 and serves as the fulcrum when a mating contact is inserted (in the direction indicated by arrow Z) into the dual beam ground contact. By adjusting the beam height, the spring rate of terminal 80A can be adjusted to a desired value, for example, according to a supplied customer specification.

Figure 10:
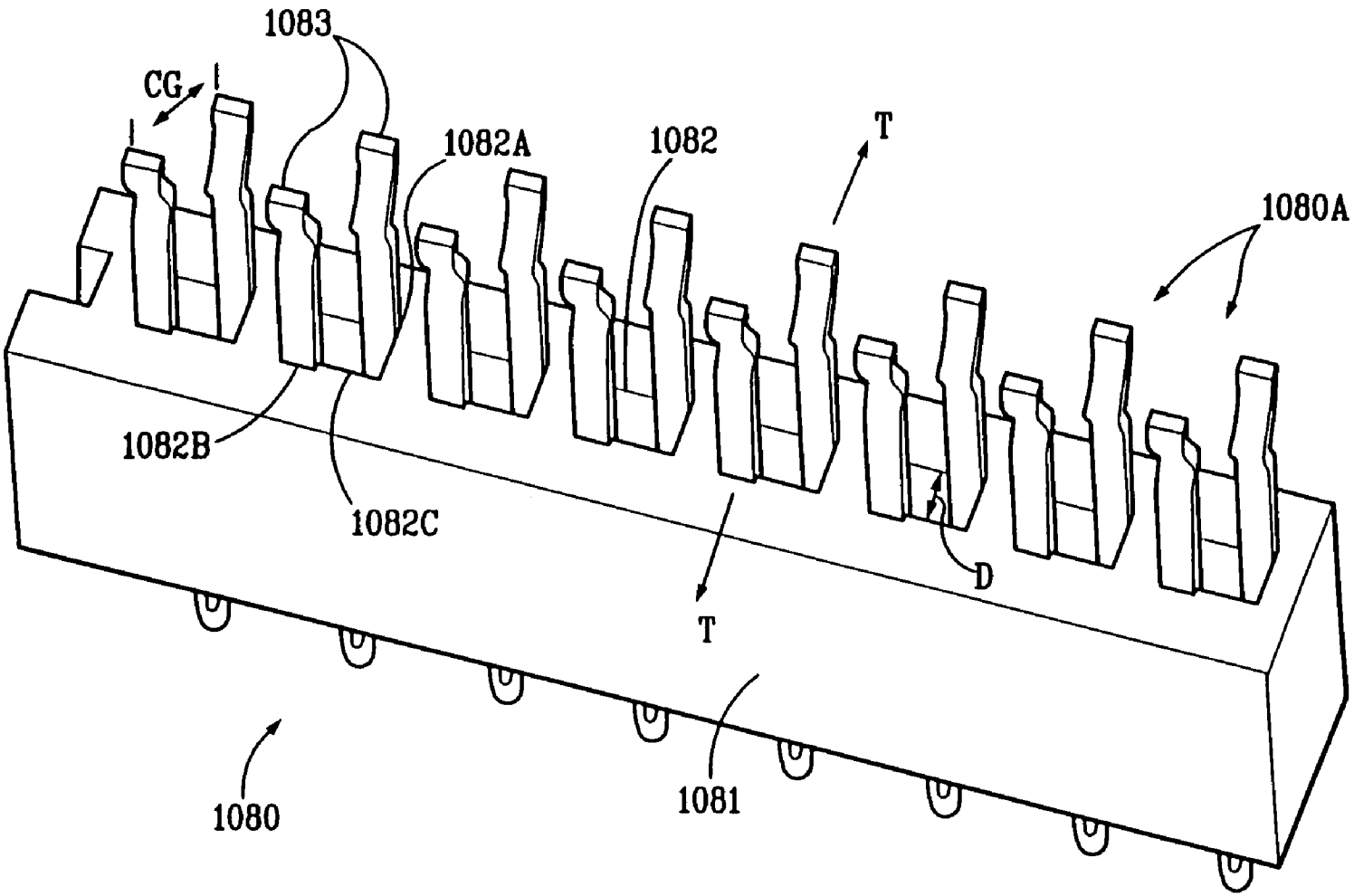
FIG. 10 is a perspective view of another single contact assembly made in accordance with the invention.

Referring now to FIG. 10, a contact assembly 1080 in accordance with the invention is shown. In this manner and as shown, the contact assembly of the invention includes eight stamped dual beam contact terminals, such as that shown in FIG. 7, i.e. one manufactured without a predetermined spring rate, in an electrical connector, yet still have a desired spring rate once installed in contact block 1081. The contact assembly may include any number of terminals without departing from the invention.

As shown in FIG. 10, contact assembly 1080 includes a contact block 1081. The contact block 1081 is typically made from an insulating material. In one embodiment, the contact block 81 is manufactured using injection molding, however, other processes may be used without departing from the scope of the invention. In general, however, the manufacturing processes and costs related to the manufacturing of the contact block are less than those that would be related to the stamping of a highly-toleranced dual beam contact according to the prior art.

Contact block 1081 includes a plurality of apertures 1082 therethrough, each aperture defined by aperture sidewalls 1082C. Furthermore, each aperture 1082 has a diameter D that can be used to tension the terminal 1080A to a determined spring rate.

Contact block 1081 also includes contains terminals 1080A, each terminal 1080A seated within an aperture 1082. As shown, terminals 1080A include dual beam contact terminals 1083 for mating with a complementary contact. For example, dual beam contact terminals 1083 may mate with a contact having a blade configuration.

In accordance with one aspect of the invention, terminals 1080A are positioned in contact block 1081 such that, once seated within the contact block 1081, the previously non-tensioned terminals become pre-loaded or tensioned in an inward direction, such inward tension is opposed to the tendency of dual beams to move in a direction opposite of arrow T. In other words, the structure of contact block 1081 prevents dual beam contact terminals 1083 from moving in a direction indicated by arrow T.

In accordance with another aspect of the invention, the dual beam contact terminals 1083 are seated in beam seats 1082A and 1082B within aperture 1082. Beam seats are cavities formed within the aperture sidewall 1082C and secure dual beam contact terminals 1083 from any lateral movement once positioned in the aperture 1082 within contact block 1081. Also, beam seats can be used to align the dual beams 1083. As such, the tolerances required to stamp terminals having a precise alignment are reduced. Consequently, manufacturing costs are also reduced. As shown, aperture seats are rectangular in shape, however, any shape may be used without departing from the scope of the invention.

FIG. 11 is a perspective view of a contact assembly in accordance with the invention mated with a pin. As shown, a mating contact or pin 1290 having a bladed configuration is inserted into dual beam contact 1283 in a direction indicated by arrow I. Once inserted, the dual beams 1283 are deflected in a direction indicated by arrow G.

In accordance with another aspect of the invention, the mating contact 1290 is not limited to the beam height or cantilevered length of terminal 1280A. In this manner, by adjusting the depth of terminal in the contact block 1281, the insertion depth $D_i$ of the mating contact can also be adjusted. The insertion depth can be adjusted to allow for contact wipe. Contact wipe is a deviation parameter used to allow for curvatures that may exist in an electrical device that results in non-simultaneous contact mating when connectors are mated. In this manner, increasing the insertion depth allows for greater contact wipe.

It is to be understood that the foregoing illustrative embodiments have been provided merely for the purpose of explanation and are in no way to be construed as limiting of the invention. Words which have been used herein are words of description and illustration, rather than words of limitation. Further, although the invention has been described herein with reference to particular structure, materials and/or embodiments, the invention is not intended to be limited to the particulars disclosed herein. Rather, the invention extends to all functionally equivalent structures, methods and uses, such as are within the scope of the appended claims. Those skilled in the art, having the benefit of the teachings of this specification, may affect numerous modifications thereto and changes may be made without departing from the scope and spirit of the invention in its aspects.

What is claimed is:

1. A contact assembly for use in an electrical connector, the contact assembly comprising:

an insulative contact block defining an aperture therethrough; and a dual beam contact inserted into the aperture in a direction of insertion and seated within the aperture, the dual beam contact having a body and a first beam and a second beam extending from the body in a direction opposite to the direction of insertion, the first and second beams opposing one another and having a distance between them, wherein the distance is defined at least in part by the contact block, and the aperture is adapted to receive both the body of the dual beam contact, and a second contact inserted between the first and second beams of the dual beam contact.

2. The contact assembly of claim 1, wherein the aperture comprises a plurality of sidewalls that define beam seats adapted to secure the first and second beams.

3. The contact assembly of claim 1, wherein the aperture is sized to provide a desired distance between the first and second beams.

4. The contact assembly of claim 1, wherein the contact comprises a projection for securing the contact to the contact block.

5. The contact assembly of claim 1, wherein the distance is selected to provide a desired spring rate of each of the first and second beams.

6. The contact assembly of claim 1, wherein the distance is selected to achieve a desired normal force.

7. The contact assembly of claim 1, wherein the dual beam contact extends a length from the contact block and wherein the distance is defined in part by the length.

8. The contact assembly of claim 1, wherein the first and second beams of the dual beam contact are adapted to deflect away from one another upon making physical contact with the second contact.

9. A receptacle connector, comprising:

a housing; and a plurality of contact assemblies contained in the housing, each contact assembly comprising:

an insulative contact block defining a plurality of apertures therethrough; and a plurality of dual beam contacts, each said contact extending through and seated in a respective aperture in the contact block, each said contact having a respective first beam and a respective second beam opposing the first beam, wherein a respective distance between the first beam and opposing second beam of each dual beam contact is defined at least in part by the contact block, wherein each of the apertures is adapted to receive a respective second contact inserted between the respective first and second beams of each dual beam contact, and wherein the respective first and second beams of each dual beam contact are adapted to deflect away from one another upon making physical contact with the respective second contact.

10. The receptacle connector of claim 9, wherein each of the plurality of apertures defines a respective plurality of sidewalls, and each of the pluralities of sidewalls define respective beam seats adapted to secure the respective first and second beams.

11. The receptacle connector of claim 9, wherein each of the plurality of apertures is sized to provide a respective desired distance between the respective first and second beams.

12. The receptacle connector of claim 9, wherein each dual beam contact extends a respective length from the contact block, and wherein a respective desired spring rate of each of the respective first and second beams can be adjusted by varying the respective length.

13. The receptacle connector of claim 9, wherein the distance is selected to achieve a desired normal force.

14. The receptacle connector of claim 9, wherein each of the plurality of contacts includes a respective projection thereon for securing a respective contact to the contact block.

15. The receptacle connector of claim 9, wherein each dual beam contact extends a respective length from the contact block, and wherein the distance for a respective contact is defined in part by the length.

16. An electrical connector assembly, comprising:

a plug connector comprising a plug contact; and a receptacle connector electrically connectable to the plug connector comprising a housing and a plurality of contact assemblies contained in the housing, each contact assembly comprising:

an insulative contact block defining a plurality of apertures therethrough; and a plurality of dual beam contacts, each contact inserted into a respective aperture in a direction of insertion and having a respective body, and respective first and second beams each extending from the body in a direction opposite the direction of insertion, wherein a respective distance between the respective first and second beams of each dual beam contact is defined at least in part by the contact block, wherein the respective aperture is adapted to receive the respective body of the respective dual beam contact and the plug contact inserted between opposing first and second beams of the respective dual beam contact.

17. The electrical connector of claim 16, wherein each of the plurality of apertures defines a respective plurality of sidewalls, and wherein each of the pluralities of sidewalls defines a respective beam seat adapted to secure the beams of a respective contact.

18. The electrical connector of claim 16, wherein each aperture is sized to provide a respective desired distance between the first and second beams of a respective contact.

19. The electrical connector of claim 16, wherein each of the plurality of contacts includes a respective projection thereon for securing the contact to the contact block.

20. The electrical connector of claim 16, wherein each dual beam contact extends a respective length from the contact block, and wherein a respective desired spring rate of each dual beam can be adjusted by varying the length.

21. The electrical connector of claim 16, wherein each dual beam contact extends a respective length from the contact block and wherein the distance for a respective contact is defined in part by the length.

22. The electrical connector of claim 16, wherein the opposing first and second beams of respective dual beam contact are adapted to deflect away from one another upon making physical contact with the plug contact.

* * * * *